US009239537B2

(12) United States Patent
Takura

(10) Patent No.: US 9,239,537 B2
(45) Date of Patent: Jan. 19, 2016

(54) IMAGE FORMING APPARATUS

(71) Applicant: CANON KABUSHIKI KAISHA, Tokyo (JP)

(72) Inventor: Keizo Takura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/630,110

(22) Filed: Feb. 24, 2015

(65) Prior Publication Data

US 2015/0241812 A1 Aug. 27, 2015

(30) Foreign Application Priority Data

Feb. 26, 2014 (JP) ..... 2014-035998

(51) Int. Cl.
*G03G 15/043* (2006.01)
*G03G 15/00* (2006.01)

(52) U.S. Cl.
CPC ..... *G03G 15/043* (2013.01); *G03G 15/5041* (2013.01); *G03G 15/5058* (2013.01)

(58) Field of Classification Search
CPC ..... G03G 15/043; G03G 15/5033; G03G 15/5041; G03G 15/5054; G03G 15/5058; G03G 2215/00042
See application file for complete search history.

(56) References Cited

U.S. PATENT DOCUMENTS

| | | | | |
|---|---|---|---|---|
| 8,521,045 | B2 * | 8/2013 | Inada | G03G 15/0131 399/11 |
| 2006/0024077 | A1 * | 2/2006 | Scheuer | G03G 15/5041 399/74 |
| 2008/0089702 | A1 * | 4/2008 | Takezawa | G03G 15/0194 399/32 |
| 2008/0145089 | A1 * | 6/2008 | Takahashi | G03G 15/50 399/74 |
| 2010/0054774 | A1 * | 3/2010 | Yamasaki | G03G 15/5058 399/49 |
| 2012/0237233 | A1 * | 9/2012 | Kato | G03G 15/0131 399/49 |

FOREIGN PATENT DOCUMENTS

| | | |
|---|---|---|
| JP | 2000-338730 A | 12/2000 |
| JP | 2004-117807 A | 4/2004 |

* cited by examiner

*Primary Examiner* — Clayton E Laballe
*Assistant Examiner* — Carla Therrien
(74) *Attorney, Agent, or Firm* — Fitzpatrick, Cella, Harper & Scinto

(57) ABSTRACT

An image forming apparatus comprises: a detection unit which detects a light amount of reflected light from a measurement image, and includes an irradiation unit which irradiates the measurement image with light, a first unit which receives specular light from the measurement image, and a second unit which receives diffused light from the measurement image; a controller which controls an image forming condition based on a detection result; and a determination unit which determines a first emission intensity based on a light amount of the specular light, and determines a second emission intensity based on the first emission intensity, the light amount of the specular light, and a light amount of the diffused light, wherein the emission intensity of light with which the irradiation unit irradiates the measurement image is controlled based on the second emission intensity.

10 Claims, 10 Drawing Sheets

FIG. 8A

S201

| |
|---|
| START DENSITY SENSOR LIGHT AMOUNT CONTROL |

S202

| | |
|---|---|
| SET LED LIGHT AMOUNT <1> | |
| STORE AVERAGE VALUE OF OUTPUT OF SPECULAR LIGHT RECEIVING UNIT<br>STORE AVERAGE VALUE OF OUTPUT OF DIFFUSED LIGHT RECEIVING UNIT | Ξ P1ave<br>Ξ S1ave |
| SET LED LIGHT AMOUNT <2> | |
| STORE AVERAGE VALUE OF OUTPUT OF SPECULAR LIGHT RECEIVING UNIT<br>STORE AVERAGE VALUE OF OUTPUT OF DIFFUSED LIGHT RECEIVING UNIT | Ξ P2ave<br>Ξ S2ave |
| SET LED LIGHT AMOUNT <3> | |
| STORE AVERAGE VALUE OF OUTPUT OF SPECULAR LIGHT RECEIVING UNIT<br>STORE AVERAGE VALUE OF OUTPUT OF DIFFUSED LIGHT RECEIVING UNIT | Ξ P3ave<br>Ξ S3ave |
| SET LED LIGHT AMOUNT <4> | |
| STORE AVERAGE VALUE OF OUTPUT OF SPECULAR LIGHT RECEIVING UNIT<br>STORE AVERAGE VALUE OF OUTPUT OF DIFFUSED LIGHT RECEIVING UNIT | Ξ P4ave<br>Ξ S4ave |
| SET LED LIGHT AMOUNT <5> | |
| STORE AVERAGE VALUE OF OUTPUT OF SPECULAR LIGHT RECEIVING UNIT<br>STORE AVERAGE VALUE OF OUTPUT OF DIFFUSED LIGHT RECEIVING UNIT | Ξ P5ave<br>Ξ S5ave |

FIG. 8B

| | |
|---|---|
| **S203** | |
| DERIVE RELATIONSHIP BETWEEN SPECULAR LIGHT AMOUNT AND CURRENT LIGHT AMOUNT BASED ON LIGHT AMOUNT VALUES AND CORRESPONDING AVERAGE VALUES OF SPECULAR LIGHT AMOUNTS, CALCULATE LIGHT EMISSION AMOUNT AT WHICH THE SPECULAR LIGHT AMOUNT IS 80% OF MAXIMUM RECEIVED SPECULAR LIGHT AMOUNT | CALCULATED LIGHT AMOUNT Ξ LP |
| **S204** | |
| CALCULATE SPECULAR/DIFFUSED RATIO AT LED LIGHT AMOUNT <1> | Ξ $\alpha$base1 = (P1ave)/(S1ave) |
| CALCULATE SPECULAR/DIFFUSED RATIO AT LED LIGHT AMOUNT <2> | Ξ $\alpha$base2 = (P2ave)/(S2ave) |
| CALCULATE SPECULAR/DIFFUSED RATIO AT LED LIGHT AMOUNT <3> | Ξ $\alpha$base3 = (P3ave)/(S3ave) |
| CALCULATE SPECULAR/DIFFUSED RATIO AT LED LIGHT AMOUNT <4> | Ξ $\alpha$base4 = (P4ave)/(S4ave) |
| CALCULATE SPECULAR/DIFFUSED RATIO AT LED LIGHT AMOUNT <5> | Ξ $\alpha$base5 = (P5ave)/(S5ave) |
| **S205** | |
| SELECT HIGHEST VALUE AMONG $\alpha$base1 TO $\alpha$base 5 | Ξ $\alpha$base_max |
| **S206** | |
| CALCULATE EMISSION INTENSITY CORRECTION COEFFICIENT | Ξ $\beta = \frac{\alpha base_max+100}{200}$ |
| **S207** | |
| DETERMINE CONTROL LIGHT AMOUNT | = LP×$\beta$ |
| **S208** | |
| SET CONTROL LIGHT AMOUNT, END CONTROL | |

IMAGE FORMING APPARATUS

BACKGROUND OF THE INVENTION

1. Field of the Invention

The present invention relates to an image forming apparatus which comprises a detection unit which detects a reflected light amount from a measurement image.

2. Description of the Related Art

Conventionally, in image forming apparatuses that use an electrophotographic image formation process, variation easily occurs in the image density due to various conditions such as the usage environment and number of printed sheets. In particular, in color image forming apparatuses that perform color printing by overlaying toner images of multiple colors, variation occurs in the color balance (so-called color tone) if variation occurs in the image densities of the various colors, and therefore the suppression of density variation has been an important issue.

In recent years, in image forming apparatuses, a measurement image is formed on a transfer member carrier, the measurement image is measured by an optical sensor, and image formation conditions such as the exposure amount and developing bias are controlled based on the results of the measurement. In the case of measuring toner, measurement is performed using the amount of change in the amounts of specular light and diffused light between when toner is present and not present. For example, in the case of measuring a measurement image formed using yellow, cyan, and magenta toner, the attached toner amount of the measurement image is detected based on the amount of diffused light from the measurement image. Also, in the case of measuring a measurement image formed using black toner, for example, the attached toner amount of the measurement image is detected based on specular light from the measurement image. In this case, if the optical sensor has a blot due to scattered toner in the image forming apparatus, the amount of emitted light and the amount of received light will decrease. The measurement precision of the optical sensor therefore decreases significantly.

The optical sensor is subjected to light emission amount adjustment before the measurement image is measured by the optical sensor. In the light emission amount adjustment performed on the optical sensor, reflected light from a region of the image carrier not having toner attached thereto (base region) is measured by the optical sensor, and the light emission amount is adjusted such that the measured value matches a predetermined value. Also, in the case of an optical sensor that measures both the amount of specular light and the amount of diffused light, the light emission amount is set such that the amount of specular light from the base region is lower than a threshold value, and furthermore the amount of diffused light from the measurement image is lower than a threshold value (Japanese Patent Laid-Open No. 2000-338730).

The specular light from the base region and the diffused light from the measurement image change depending on the apparatus configuration, the wear of the image carrier, and the like. For this reason, if the light emission amount is determined based on either the amount of specular light from the base region or the amount of diffused light from the measurement image, and then the amount of received light based on the other one exceeds the threshold value, re-adjustment needs to be performed (see Japanese Patent Laid-Open No. 2004-117807).

However, conventional techniques have the problem that a long amount of time is required for adjusting the light emission amount. Furthermore, since a measurement image is formed in order to carry out light emission amount adjustment, there is the problem that toner is consumed. Also, if the change in the amount of specular light is caused by scratching or blotting on the base region in addition to blotting on the optical sensor, it is possible for a change to occur in the characteristics of the light emission amount and the amount of diffused light, and the characteristics of the toner density and the light emission amount. For this reason, there is also the possibility of not being able to set an appropriate light emission amount according to which the amount of specular light and the amount of diffused light do not exceed the threshold values.

In light of the above circumstances, according to an aspect of the present invention, downtime is suppressed when executing light emission amount adjustment on the optical sensor, and the amount of toner consumed due to the light emission amount adjustment is reduced.

SUMMARY OF THE INVENTION

According to one aspect of the present invention, there is provided an image forming apparatus comprising: an image carrier; an image forming unit configured to form an image on the image carrier using a developing agent; a detection unit configured to detect a light amount of reflected light from a measurement image formed on the image carrier by the image forming unit, the detection unit includes an irradiation unit configured to irradiate the measurement image with light, a first light receiving unit configured to receive specular light from the measurement image, and a second light receiving unit configured to receive diffused light from the measurement image; a controller configured to control an image forming condition based on a detection result by the detection unit; and a determination unit configured to make the irradiation unit to irradiate the image carrier using the light, make the first light receiving unit to receive specular light from the image carrier, make the second light receiving unit to receive diffused light from the image carrier, determine a first emission intensity based on a light amount of the specular light from the image carrier, and determine a second emission intensity based on the determined first emission intensity, the light amount of the specular light from the image carrier, and a light amount of the diffused light from the image carrier, wherein the emission intensity of light with which the irradiation unit irradiates the measurement image is controlled based on the second emission intensity determined by the determination unit.

According to another aspect of the present invention, there is provided an image forming apparatus comprising: an image forming unit configured to form an image in a predetermined region using a developing agent; a detection unit configured to detect a density of an image formed by the image forming unit, the detection unit being configured to include an irradiation unit configured to irradiate the predetermined region with light, a first light receiving unit configured to receive specular light from the predetermined region, and a second light receiving unit configured to receive diffused light from the predetermined region; and a control unit configured to control an emission intensity of light with which the detection unit is irradiated by the irradiation unit, wherein the control unit determines an emission intensity for detecting a density of an image formed by the image forming unit such that a specular light amount and a diffused light amount detected by the first light receiving unit and the second light receiving unit are within a detectable range of light amounts, based on a relationship between specular light amounts and diffused light amounts obtained by the first light receiving unit and the second light receiving unit for a plurality of emission intensities set as an emission intensity of the irradiation unit by the control unit in a state in which an image is not formed in the predetermined region by the developing agent.

According to an aspect of the present invention, downtime can be suppressed when executing light emission amount adjustment on the optical sensor, and the amount of toner consumed due to the light emission amount adjustment can be reduced.

Further features of the present invention will become apparent from the following description of exemplary embodiments (with reference to the attached drawings).

BRIEF DESCRIPTION OF THE DRAWINGS

FIGS. 8A and 8B are diagrams for describing operational content of steps in the flowchart of operations performed by the image forming apparatus according to the first embodiment.

DESCRIPTION OF THE EMBODIMENTS

Embodiments of the present invention will be described below with reference to the accompanying drawings.

First Embodiment

Image Forming Apparatus

Figure 1:
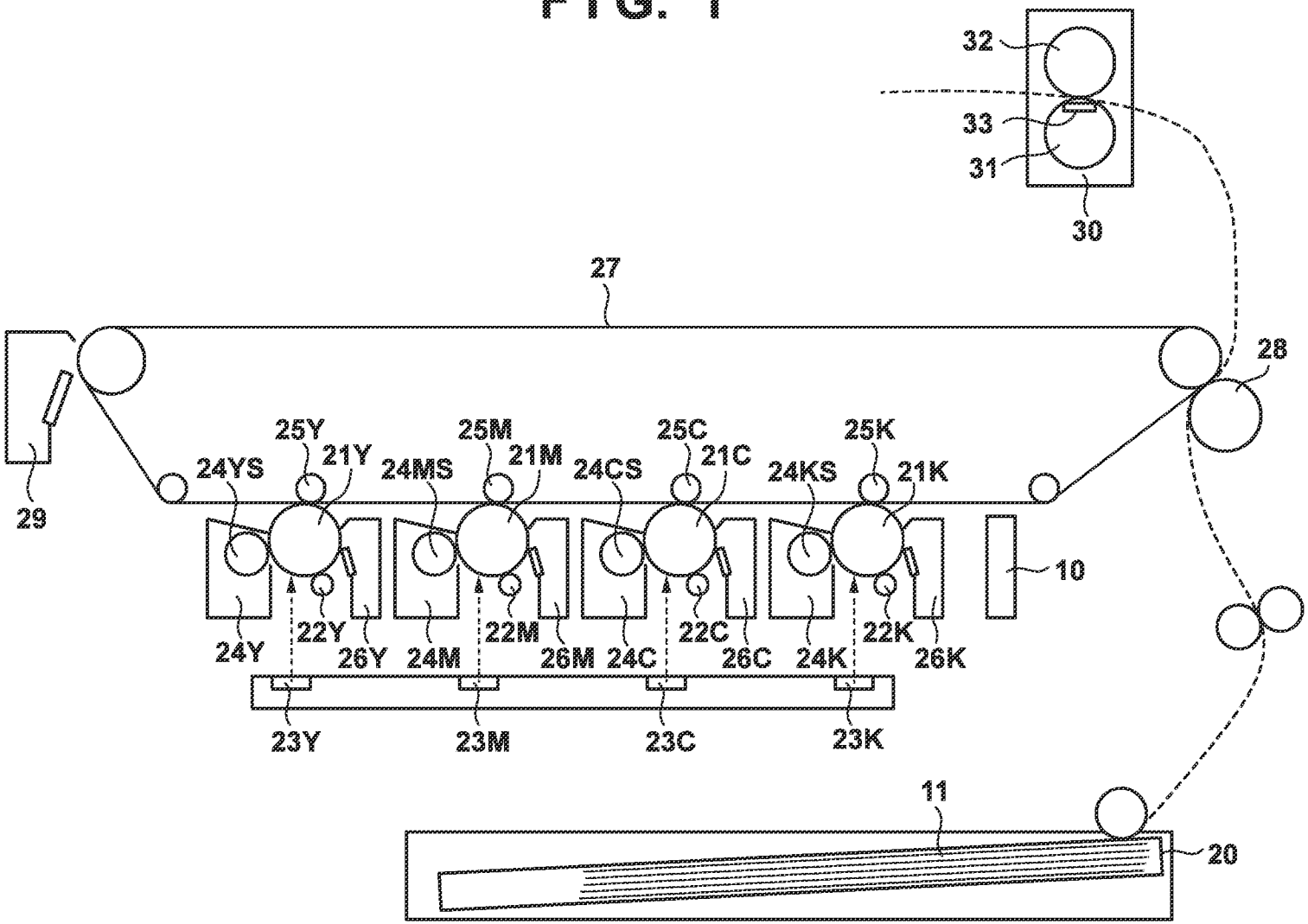
FIG. 1 is a schematic cross-sectional diagram of an image forming apparatus.

FIG. 1 is a schematic cross-sectional diagram of a color image forming apparatus according to a first embodiment. The electrophotographic image forming apparatus shown in FIG. 1 has a tandem configuration employing an intermediate transfer member 27.

The image forming apparatus includes a sheet feeding unit 20, four image forming units, the intermediate transfer member 27, a secondary transfer roller 28, a cleaning unit 29, a fixing unit 30, and a density sensor 10. The image forming units respectively have photosensitive drums 21Y, 21M, 21C, and 21K, charging units 22Y, 22M, 22C, and 22K, exposing units 23Y, 23M, 23C, and 23K, developing units 24Y, 24M, 24C, and 24K, and primary transfer rollers 25Y, 25M, 25C, and 25K. In the case where the image forming apparatus forms an image, first, an image processing unit (not shown) converts image data received from a reader, a scanner, or an external PC, photosensitive members are exposed based on the converted image data, and electrostatic latent images are formed. The image forming apparatus then forms toner images by developing the electrostatic latent images using a developing agent that has toner, and forms a full-color toner image by overlaying the toner images formed for each color component. The image forming apparatus then transfers the full-color toner image to a transfer member 11, and fixes the toner image to the transfer member 11.

The photosensitive drums 21Y, 21M, 21C, and 21K, which are photosensitive members, are formed by applying an organic photoconductive layer to the outer side of an aluminum cylinder, and rotate upon receiving drive force from a drive motor (not shown). In FIG. 1, the drive motor (not shown) rotates the photosensitive drums 21Y, 21M, 21C, and 21K in accordance with the image forming operation.

Four charging rollers 22Y, 22M, 22C, and 22K are provided as the charging units in order to respectively charge the yellow (Y), magenta (M), cyan (C), and black (K) photosensitive members of the respective image forming units. The four charging rollers 22Y, 22M, 22C, and 22K rotate in accordance with the rotation of the photosensitive drums 21Y, 21M, 21C, and 21K. Scanner units 23Y, 23M, 23C, and 23K respectively irradiate the photosensitive drums 21Y, 21M, 21C, and 21K with exposure light, and the electrostatic latent images are formed by selectively exposing the surfaces of the photosensitive drums 21Y, 21M, 21C, and 21K.

In order to visualize the electrostatic latent images, the image forming apparatus further includes four developers 24Y, 24M, 24C, and 24K, as the developing units, that perform yellow, magenta, cyan, and black developing on the respective image forming units. The developers are respectively provided with sleeves 24YS, 24MS, 24CS, and 24KS that carry and transfer a developing agent for developing the electrostatic latent images.

The intermediate transfer member 27 is in contact with the photosensitive drums, 21Y, 21M, 21C, and 21K, and rotates in the counter-clockwise direction in color image formation. Four primary transfer rollers 25Y, 25M, 25C, and 25K serving as the primary transfer units are provided at positions respectively opposing the photosensitive drums 21Y, 21M, 21C, and 21K with the intermediate transfer member 27 therebetween. The primary transfer rollers 25Y, 25M, 25C, and 25K also rotate in accordance with the rotation of the photosensitive drums 21Y, 21M, 21C, and 21K and the intermediate transfer member 27, and thus toner images of respective colors are transferred onto the intermediate transfer member 27. Thereafter, the secondary transfer roller 28, which serves as a secondary transfer unit and is in contact with the intermediate transfer member 27, grips and conveys the transfer member 11, and the full-color toner image on the intermediate transfer member 27 is transferred to the transfer member 11.

A fixing unit 30 fuses the transferred toner image while conveying the transfer member 11. The fixing unit 30 includes a fixing heating unit 31 that applies heat to the transfer member 11, and a pressing roller 32 for pressing the transfer member 11 against the fixing heating unit 31. The fixing heating unit 31 is configured by a tubular highly heat-resistant thin film, and a support structure body and a heating heater 33 inside the highly heat-resistant thin film. In other words, the transfer member 11 holding the toner image is conveyed by and subjected to heat and pressure by the fixing heating unit 31 and the pressing roller 32, and thus the toner image is fixed to the transfer member 11. After the toner image has been fixed, the transfer member 11 is ejected to a paper ejection tray by an ejection roller (not shown).

The cleaning unit 29 cleans off toner remaining on the intermediate transfer member 27. After the full-color toner image formed on the intermediate transfer member 27 has been transferred to the transfer member 11, the toner remaining on the intermediate transfer member 27 is stored in a cleaner container (not shown).

Note that the image conveying speed (process speed) of the image forming apparatus used in the present embodiment is assumed to be set to 160 mm/sec.

Determination of Light Amount of Density Sensor of Image Forming Apparatus

Figure 2:
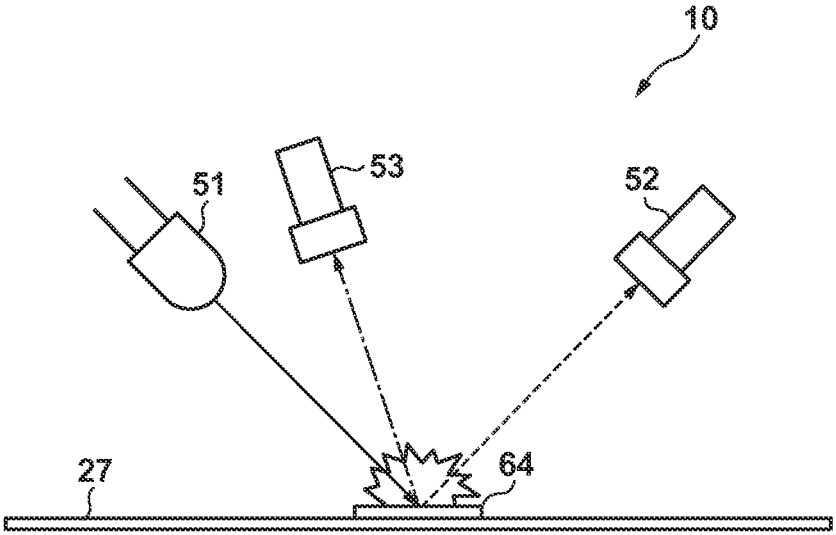
FIG. 2 is a conceptual diagram of a density sensor arrangement according to an embodiment of the present invention.

The following describes the density sensor 10. In the image forming apparatus shown in FIG. 1, the density sensor 10 is arranged in opposition to the intermediate transfer member 27, which is the image carrier for carrying an image, and measures the density of a measurement image formed on the surface of the intermediate transfer member 27. FIG. 2 shows the configuration of the density sensor 10. The density sensor 10 is constituted by an infrared light emitting device 51 such as an LED, a specular light receiving device 52 and a diffused light receiving device 53 such as a photodiode, an IC (not shown) for performing arithmetic operations on light reception data, and a casing (not shown) for accommodating these devices. Note that for the sake of convenience, the infrared light emitting device 51 will also be referred to as the irradiation unit, the specular light receiving device 52 will also be referred to as the first light receiving unit, and the diffused light receiving device 53 will also be referred to as the second light receiving unit.

The infrared light emitting device 51 is installed at a 45-degree angle to the direction orthogonal to the surface of the intermediate transfer member 27, and emits infrared light toward the intermediate transfer member 27. The specular light receiving device 52 detects specular light from the intermediate transfer member 27 or a measurement image 64 formed on the intermediate transfer member 27 (shown by the dashed arrow in FIG. 2). The diffused light receiving device 53 is installed at a position 20 degrees from the direction orthogonal to the surface of the intermediate transfer member 27, toward the infrared light emitting device 51. The diffused light receiving device 53 detects diffused light from the intermediate transfer member 27 or the measurement image 64 formed on the intermediate transfer member 27 (shown by the dashed-dotted arrow in FIG. 2). The diffused light receiving device 53 does not receive specular light from the measurement image 64.

Note that the arrangement relationship between these devices is not limited to the above description. Also, the infrared light emitting device 51, the specular light receiving device 52, and the diffused light receiving device 53 may be provided with an optical element (not shown) such as a lens, for example.

The intermediate transfer member 27 is a single-layer resin belt that is made of a polyimide and has a circumferential length of 800 mm, for example. The intermediate transfer member 27 has an appropriate amount of carbon microparticles dispersed in the resin in order to adjust the electrical resistance of the belt, and the surface color is black. Furthermore, the surface of the intermediate transfer member 27 is highly smooth and glossy, and it is assumed that the glossiness is approximately 100% (as measured by the gloss checker IG-320 manufactured by Horiba, Ltd.).

The surface of the intermediate transfer member 27 is glossy. For this reason, when the measurement image has not been formed on the intermediate transfer member 27, the specular light receiving device 52 of the density sensor 10 obtains a received light amount proportional to the light emission amount of the infrared light emitting device 51.

Figure 3A:
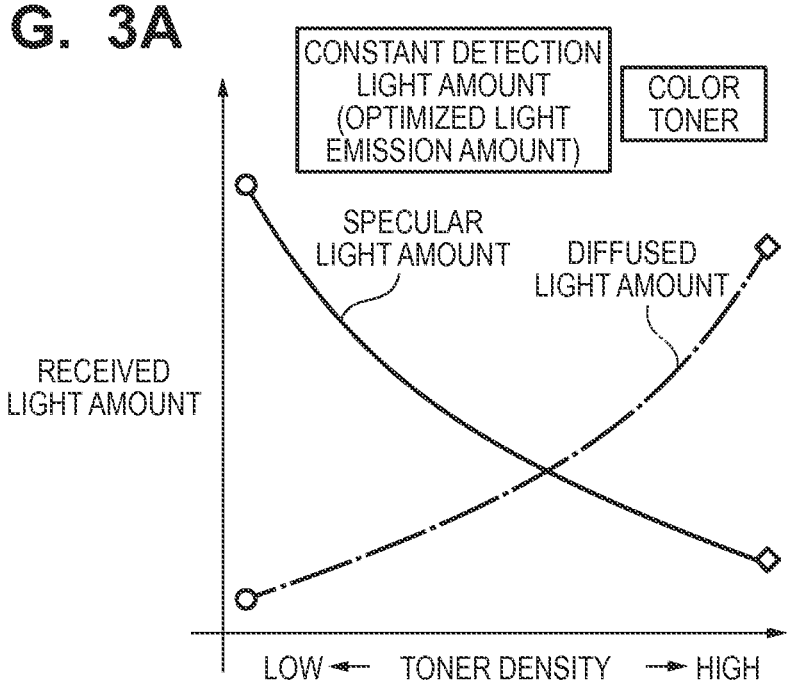
FIGS. 3A and 3B are diagrams for describing change in a specular light amount and a diffused light amount.
Figure 3B:
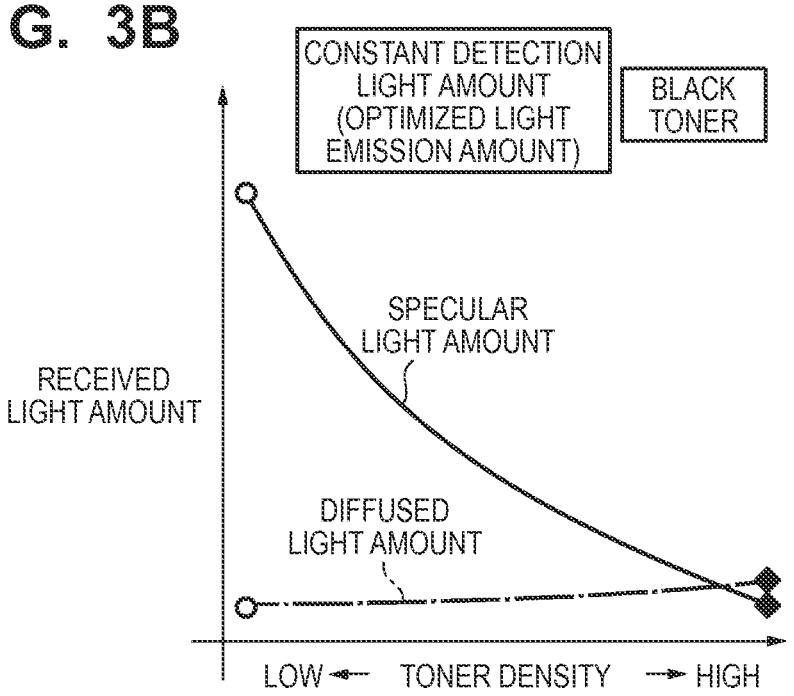
Figure 4A:
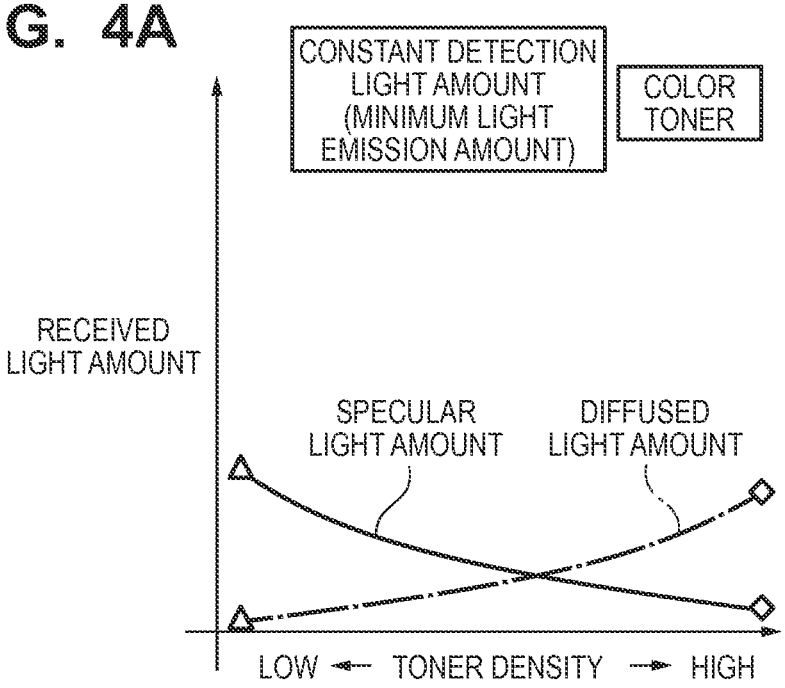
FIGS. 4A and 4B are diagrams for describing change in the specular light amount and the diffused light amount.
Figure 4B:
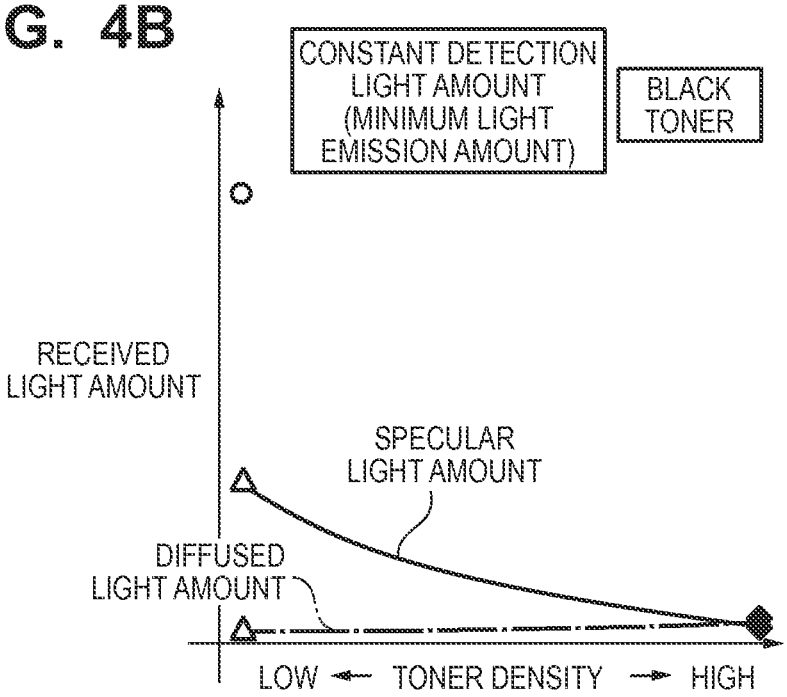

On the other hand, if the measurement image has been formed on the intermediate transfer member 27, the received light amount changes according to the color of the toner used to form the measurement image. The relationship between the density of the measurement image and the received light amount is shown in FIGS. 3A and 3B and in FIGS. 4A and 4B. In FIGS. 3A and 3B and FIGS. 4A and 4B, the vertical axis indicates the received light amount, and the horizontal axis indicates the density of the measurement image. The received light amount differs between FIGS. 3A and 3B and FIGS. 4A and 4B.

As the density (applied toner amount) of the yellow, magenta, and cyan measurement images increases, the specular reflection output of the specular light receiving device 52 (specular light amount) gradually decreases, and the diffuse reflection output of the diffused light receiving device 53 (diffused light amount) gradually increases (FIG. 3A). On the other hand, as the density (applied toner amount) of the black toner image increases, the specular reflection output gradually decreases, and the diffuse reflection output does not increase (FIG. 3B). The amount of specular light from the surface of the intermediate transfer member 27 decreases due to the surface of the intermediate transfer member 27 being covered by toner. Also, since the yellow, magenta, and cyan toner disperses the infrared light emitted by the infrared light emitting device 51, the diffuse reflection output increases as the density (applied toner amount) of the toner image increase. Note that the diffuse reflection output does not change due to the fact that black toner absorbs light.

Using this characteristic, the applied toner amount for the yellow, magenta, and cyan toner is measured based on the relationship between the applied toner amount and the diffuse reflection output, and the applied toner amount for the black toner is measured based on the relationship between the applied toner amount and the specular reflection output. Note that the final applied toner amount may be calculated using both the specular and diffuse reflection output values rather than using only one reflection output value.

It is desirable that the density sensor 10 obtains a reception signal with a highest dynamic range as possible in order to improve the S/N ratio. For example, it is desirable that the amount of received specular light, which is the main indicator of the level in black toner density detection, and the amount of received diffused light, which is the main indicator of the level in color toner density detection, are both as high as possible. However, in the case of performing toner density detection using a configuration including one irradiation unit and two light receiving units, the light emission amount is the same since there is only one light source, and therefore when the light emission amount is changed, the change in the detected amount of reflected light is similar for both of the light receiving units. However, a comparison of FIGS. 3A and 3B and FIGS. 4A and 4B shows that although the absolute value of the received light amount on the vertical axis changes, the relationship between the specular light amount and the diffused light amount does not change for both the color toner and the black toner. In view of this, in the present embodiment, this relationship is derived and used in controlling the emission intensity (light emission amount) when performing toner image density detection.

In the adjustment of the light emission amount of the infrared light emitting device 51 in the present embodiment, first, the emission intensity of the infrared light emitting device 51 is adjusted to a specified value by an emission intensity adjustment unit (not shown), and the amount of specular light from the surface of the intermediate transfer member 27 serving as the base is measured. After measurement has been performed for a specified time period (i.e., a specified distance on the intermediate transfer member 27), the emission intensity of the infrared light emitting device 51 is re-adjusted, and the amount of specular light from the surface of the intermediate transfer member 27 serving as the base is measured with a different emission intensity. This is repeated multiple times, the relationship between the emission intensity of the infrared light emitting device 51 and the amount of specular light from the surface of the intermediate transfer member 27 is obtained, and the emission intensity of the infrared light emitting device 51 needed to obtain a target amount of specular light from the surface of the intermediate transfer member 27 is calculated.

In the present embodiment, the emission intensity of the LED serving as the infrared light emitting device is first set to an LED light amount <1>. Thereafter, a period of 375 ms is waited for to allow for the change in light amount and stabilization of the measurement value, and then the specular light receiving device 52 and the diffused light receiving device 53 perform reflected light amount measurement at a predetermined time interval or position interval. In the present embodiment, the reflected light amount measurement is performed at 100 points (100 locations) every 6.25 ms. As a result, the average values over 625 ms (100 mm on the intermediate transfer member 27) are stored as a specular light amount P1ave and a diffused light amount S1ave corresponding to that emission intensity. In other words, in the present embodiment, 1000 ms is required for one execution of setting and measurement.

In the present embodiment, the LED emission intensity is furthermore set to LED light amounts <2>, <3>, <4>, and <5>, and specular light amounts P2ave, P3ave, P4ave, and P5ave and diffused light amounts S2ave, S3ave, S4ave, and S5ave respectively corresponding to the emission intensities are stored. In other words, setting and measurement are performed a total of five times. Note that the number of times measurement is performed, and the interval between measurements are not limited to the above description, and may be increased or reduced as necessary. Also, it is assumed that the LED light amount values have been defined in advance.

In the present embodiment, the target specular light amount is set to 80% of the measurement limit value of the light receiving device. This value is determined in consideration of variation in the surface characteristics of the intermediate transfer member 27, and there is no limitation to this value. The specular light amount and the diffused light amount are subjected to analog-digital conversion to obtain 8-bit values from 0 to 255, and therefore the target value is set to "200", which is approximately 80% of the maximum value of 255 after analog-digital conversion. Note that although the same receiving device is used for the specular light receiving device 52 and the diffused light receiving device 53 in the description of the present embodiment, there is no limitation to this. In the case of using light receiving elements that have different measurement limit values, the target value and the LED light amounts in adjustment need only be set according to the corresponding measurement limit value.

The LED emission intensity for obtaining "200" as the target specular light amount is determined based on the relationship between the LED light amounts <1> to <5> and the specular light amounts P1ave to P5ave. Furthermore, using the relationship between the specular light amounts P1ave to P5ave and the diffused light amounts S1ave to S5ave, ratios αbase1 to αbase5 of the specular light amount to the diffused light amount in the base region are calculated based on Expression 1 below. The highest value among the obtained ratios is stored as the specular/diffused ratio for the base region.

$$\alpha\text{base}(n)=P(n)\text{ave}/S(n)\text{ave}(n=1\text{ to }5) \qquad \text{Expression 1}$$

Note that although the highest value among the calculated ratios is used in the present embodiment, it is possible to use the average value, the lowest value, the median value, or the average of the high and low ratios of the specular light amount to the diffused light amount in the section including the obtained LED light amount. The specular/diffused ratios αbase1 to αbase5 in the base region all have the same value in an apparatus in the ideal state. Accordingly, in consideration of safety and the like in the configuration of the apparatus, a smaller value may be selected.

When the intermediate transfer member 27 serving as the base is in the initial state (i.e., when there are no blots and no reduction in glossiness), the specular/diffused ratio in the base region has a relatively high value since the specular light amount is high. If the glossiness has decreased due to scratching or blotting on the surface of the intermediate transfer member 27, the specular light amount decreases, and the diffused light amount increases. As a result, the specular/diffused ratio in the base region becomes relatively smaller. For this reason, it is possible to predict the state of the surface of the intermediate transfer member 27 from the specular/diffused ratio in the base region.

Figure 5A:
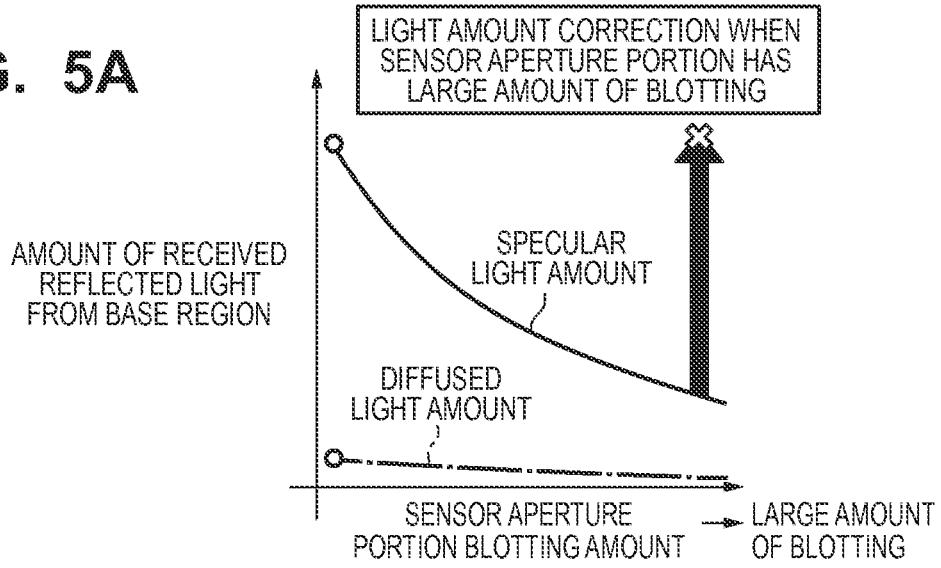
FIGS. 5A, 5B, and 5C are diagrams for describing change in the specular light amount and the diffused light amount.
Figure 5B:
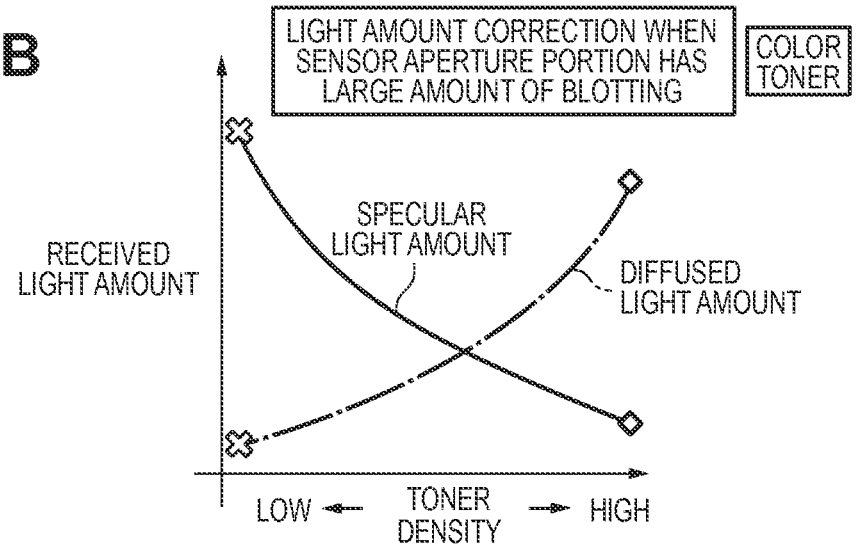
Figure 5C:
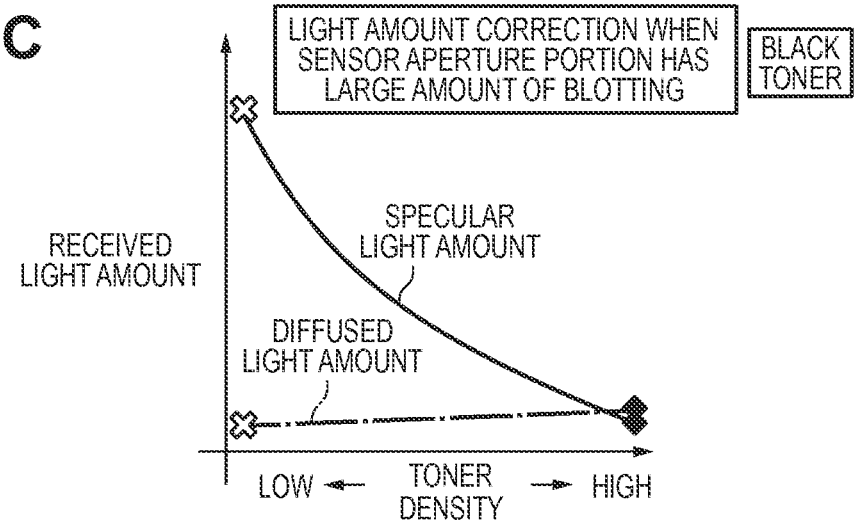

FIGS. 5A to 5C show the relationship between the amount of received reflection light and blotting. In FIG. 5A, the vertical axis indicates the amount of reflected light received from the base region, and the horizontal axis indicates the sensor blot amount. In the case where the light emission amount is constant, the amount of received light decreases as the amount of sensor blotting increases for both the specular light amount and the diffused light amount. Also, FIGS. 5B and 5C show the relationship between the amount of received light and the toner density for each type of toner when the amount of sensor blotting is high. It can be seen that the relationships shown in FIGS. 5B and 5C are substantially the same as the relationships shown in FIGS. 3A and 3B.

Figure 6A:
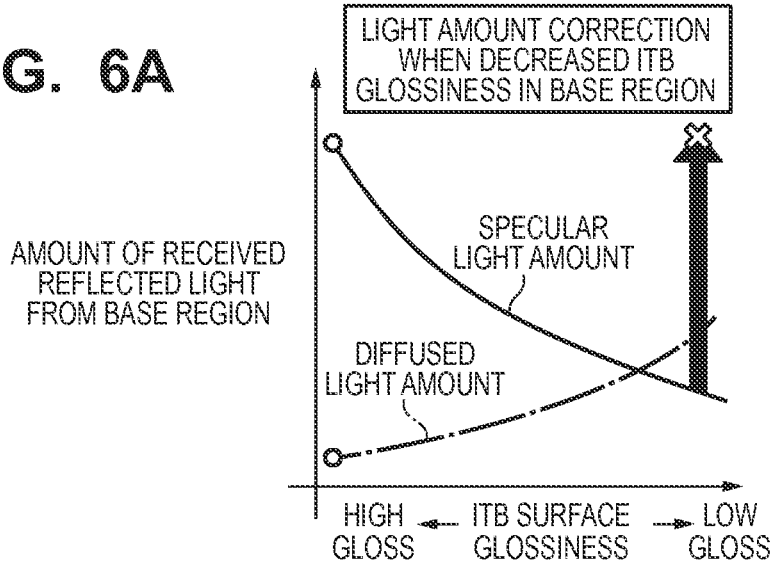
FIGS. 6A, 6B, and 6C are diagrams for describing change in the specular light amount and the diffused light amount.
Figure 6B:
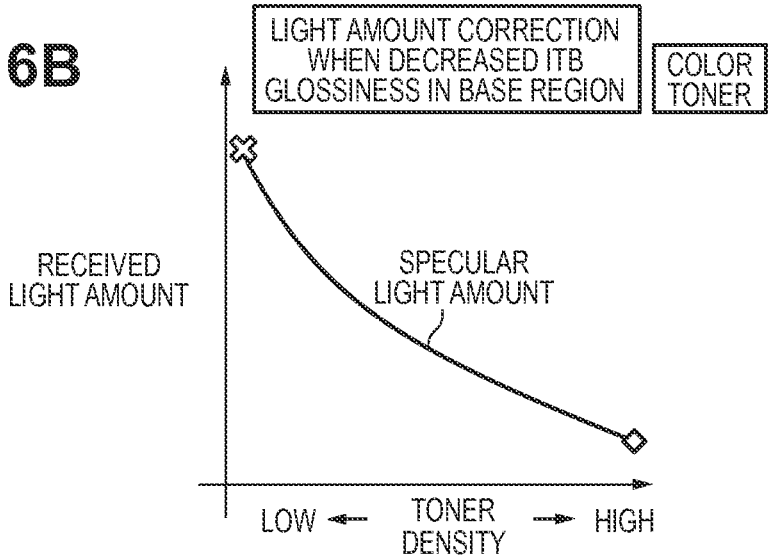
Figure 6C:
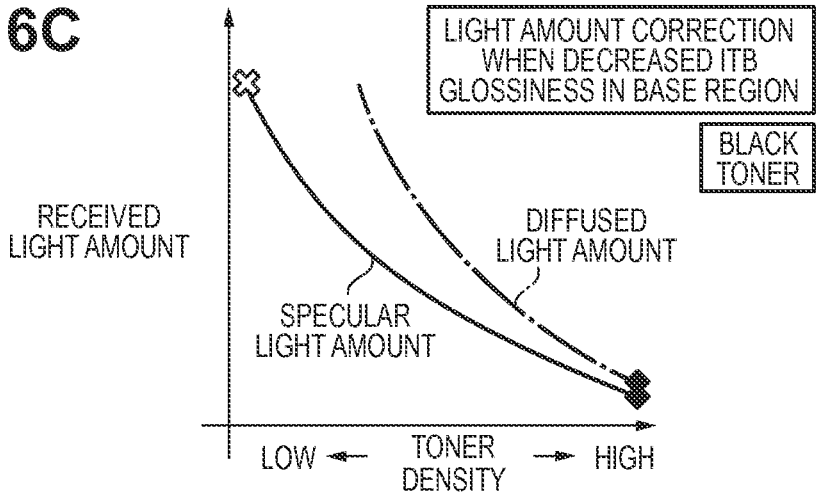

FIGS. 6A to 6C show the relationship between the amount of received reflection light and the surface state (glossiness state). In FIG. 6A, the vertical axis indicates the amount of reflected light received from the base region, and the horizontal axis indicates the surface state. In the case where the light emission amount is constant, the specular light amount decreases as the glossiness decreases, whereas the diffused light amount increases as the glossiness decreases. Also, FIGS. 6B and 6C show the relationship between the amount of received light and the toner density for each type of toner when the glossiness has decreased. In FIG. 6B, the amount of received specular light decreases as the toner density increases. Here, the diffused light amount is higher than the specular light amount and exceeds the measurement limit of the diffused light receiving device 53, and therefore cannot be measured. In FIG. 6C, the amount of received specular light and the amount of received diffused light decrease as the toner density increases. Note that if the amount of black toner is low, the amount of received diffused light amount exceeds the measurement limit of the diffused light receiving device 53, and therefore cannot be measured.

Based on the relationships shown in FIGS. 5A to 5C and FIGS. 6A and 6C, it can be thought that if the glossiness of the surface of the intermediate transfer member 27 has decreased due to scratching or blotting, the state is similar to the state in which a measurement image has been formed on the intermediate transfer member 27. The amount of diffused light from the measurement image relative to the amount of specular light from the base region can be predicted by using the specular/diffused ratio in the base region.

In the present embodiment, in the case where the specular/diffused ratio in the base region is greater than or equal to 100, as long as the LED emission intensity has been determined based on the target specular light amount, the amount of diffused light from the measurement image does not exceed the measurement limit. However, when the intermediate transfer member 27 has a surface state in which the measurement limit has been reached with respect to the transfer characteristic or other control, with the LED emission intensity determined based on the target specular light amount, it has been confirmed that the amount of diffused light from the measurement image exceeds approximately double the measurement limit. In this case, the diffused light amount cannot be measured, as shown in FIGS. 6B and 6C. In view of this, the light emission amount is corrected using an emission intensity correction coefficient such that the specular light amount and the diffused light amount are less than or equal to the measurement limits of the respective light receiving units.

In the present embodiment, the emission intensity correction coefficient is defined as shown in Expression 2 below. Here, β represents the emission intensity correction coefficient, and αbase_max represents the highest value among the specular/diffused ratios in the base region.

$$\beta=(\alpha base_max+100)/200 \qquad \text{Expression 2}$$

In Expression 2, the emission intensity correction coefficient β is defined as the ratio of the sum of the calculated ratio α and the ratio "100" at which the diffused light amount does not exceed the measurement limit, to the target value of "200".

Letting LP be the LED emission intensity determined based on the target specular light amount, the LED emission intensity LPlast to be used in control is obtained using Expression 3 below.

$$LPlast=LP\times\beta \qquad \text{Expression 3}$$

Using this LED emission intensity LPlast makes it possible to appropriately measure the density even if, for example, the density sensor 10 has become blotted, or the surface of the intermediate transfer member 27 is in a state where the glossiness has decreased due to scratching or blotting. As a result, it is possible to minimize downtime, and also eliminate the consumption of toner due to light emission amount adjustment.

Configuration of Control Unit of Image Forming Apparatus

Figure 9:
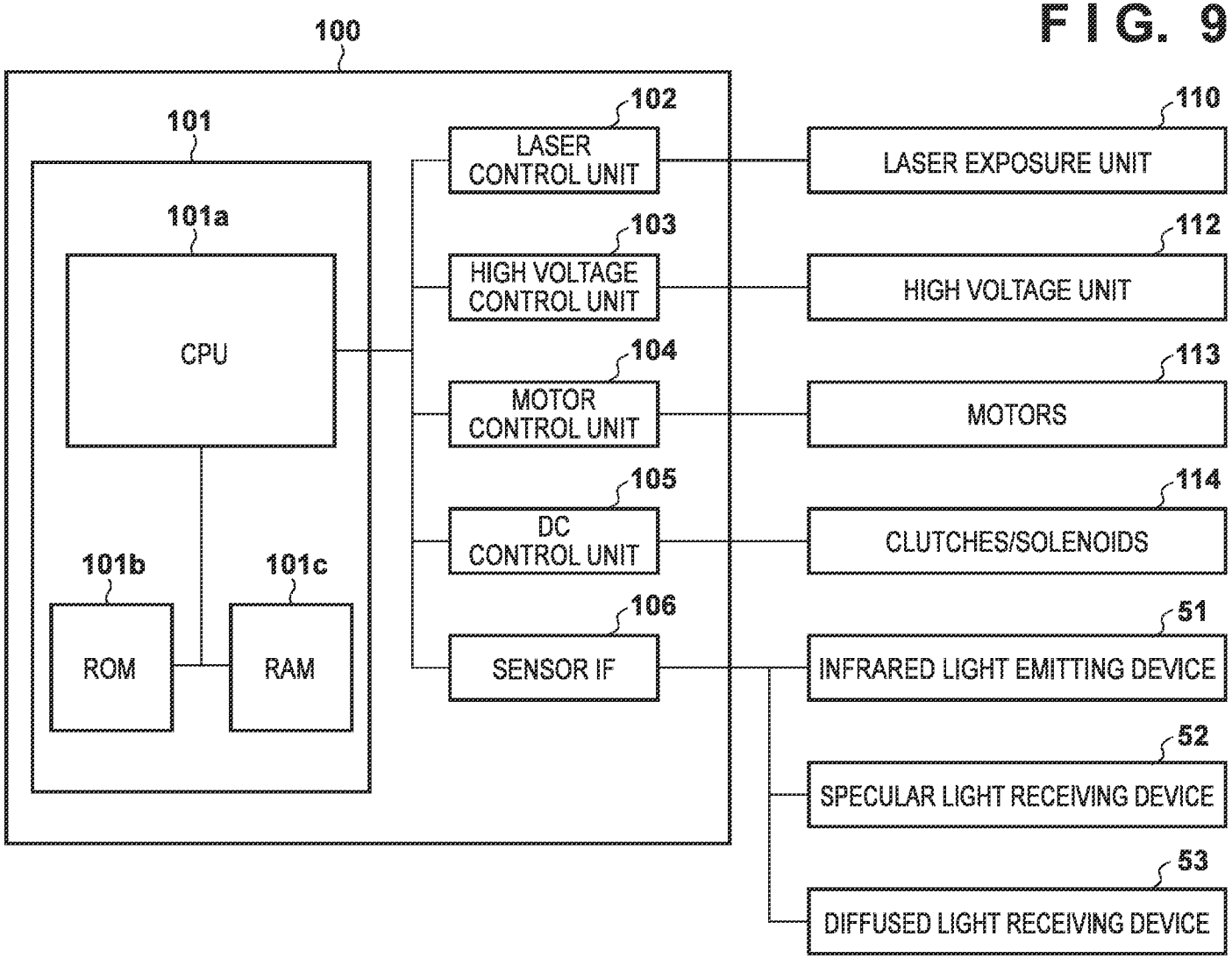
FIG. 9 is a diagram showing an example of a configuration of a control unit of the image forming apparatus according to the first embodiment.

FIG. 9 is a block diagram showing an example of the configuration of the control unit of the image forming apparatus. Overall control of the image forming apparatus is performed by the control unit 100. The control unit 100 controls overall operation of the image forming apparatus by, for example, driving drive elements using various types of motors and clutches included in the image forming apparatus, controlling the exposure of the laser that performs latent image exposure, controlling various types of high voltages, and collecting and analyzing information from sensors.

The control unit 100 includes a ROM 101*b* that stores programs for executing various types of processing (image forming sequences) to be executed in the image forming apparatus, and a CPU 101*a* that executes the programs stored in the ROM 101*b*. The control unit 100 also includes a RAM 101*c* for storing rewritable data that needs to be stored temporarily. The RAM 101*c* is used as a deployment region for the programs stored in the ROM 101*b*. The RAM 101*c* stores various types of data and a high voltage setting value for a high voltage control unit 103, control values set according to information from various types of sensors, and the like.

The image forming apparatus includes motors 113, clutches/solenoids, and the like for rotating rotational parts such as the photosensitive drums 21Y, 21M, 21C, and 21K and drive rollers. In the image forming apparatus, the conveying of the transfer member 11 and the driving of various types of units are performed by appropriately driving the motors 113 and DC loads, and these operations are controlled by a motor control unit 104.

Also, a high voltage unit 112 applies appropriate high voltages to various types of charging units included in the image forming apparatus (the primary charging unit, the developing unit, the primary transfer unit, and the secondary transfer unit). The high voltage unit 112 operates in accordance with a high voltage control signal from the high voltage control unit 103.

In the control unit 100, signals from the specular light receiving device 52 and the diffused light receiving device 53 are received by a sensor IF (interface) 106 and processed by the CPU 101*a*. In the present embodiment, the CPU 101*a* determines the LED emission intensity to be used in control based on signals from the specular light receiving device 52 and the diffused light receiving device 53 of the density sensor 10, which is one of the sensors. The operation content for arriving at this determination will be described below with reference to the flowchart in FIG. 7.

Flowchart of Image Forming

Figure 7:
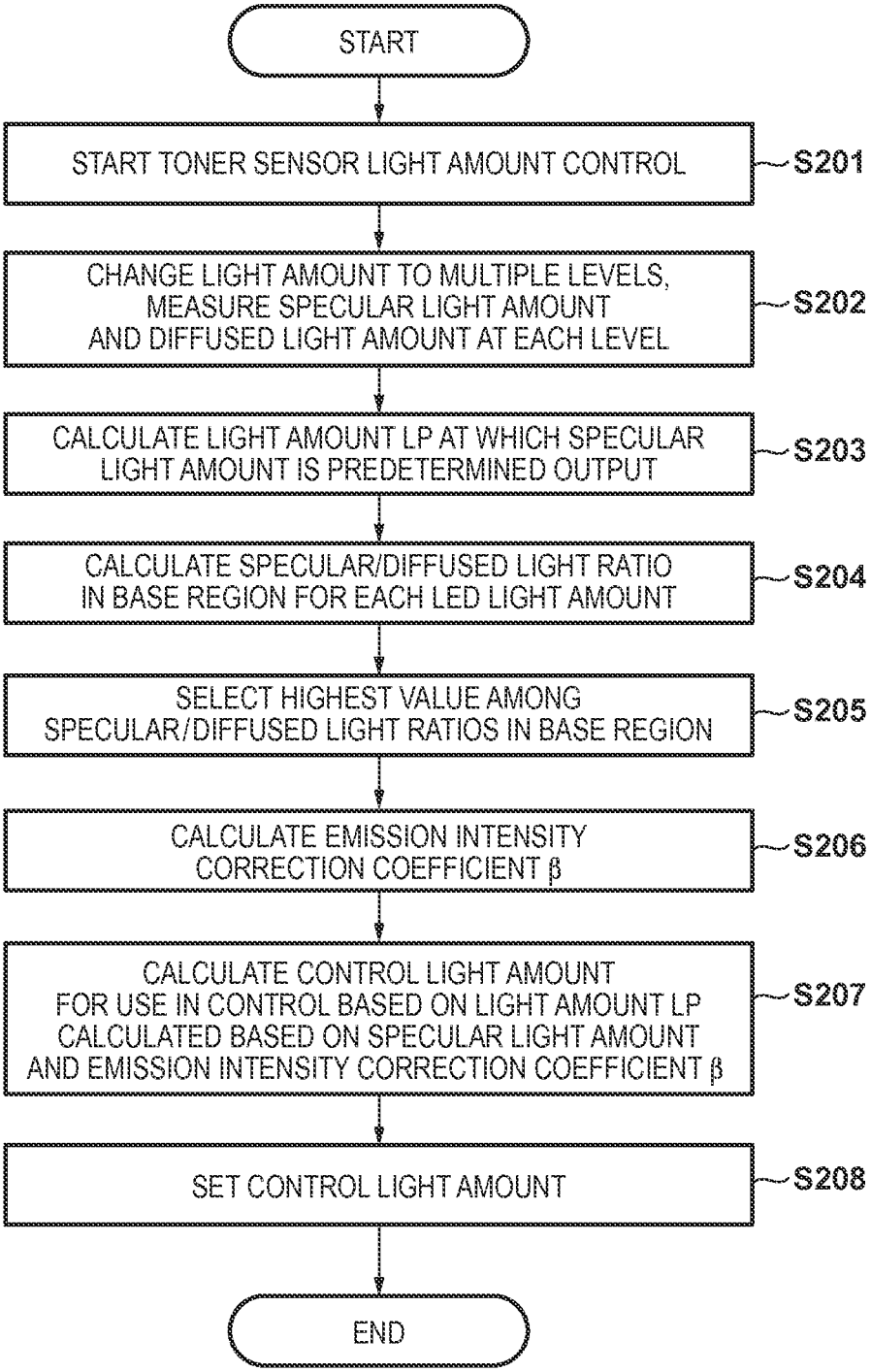
FIG. 7 is a flowchart of operations performed by an image forming apparatus according to a first embodiment.

The image forming operation by which the image forming apparatus forms an image based on image data will be described below based on the flowchart in FIG. 7 and the operation content shown in FIGS. 8A and 8B. The CPU 101*a* executes the image forming operation by reading out a program stored in the ROM 101*b*.

In step S201, the CPU 101*a* starts performing light amount control on the density sensor 10. The CPU 101*a* starts the light amount control if a counter value that indicates the number of printed pages and is stored in a storage unit such as a nonvolatile memory exceeds a threshold value. The CPU 101*a* executes density detection processing each time 500 pages worth of images have been printed. The CPU 101*a* executes light amount control on the density sensor 10 before executing the density detection processing.

In step S202, the CPU 101*a* sets the LED emission intensity to an LED light amount 1. The CPU 101*a* then measures the specular light amount and diffused light amount for 100 points (a length of 100 mm on the intermediate transfer member 27), and stores a specular light amount average value P1ave and a diffused light amount average value S1ave that are based on the measured values.

In step S202, the CPU 101*a* sets the LED emission intensity and repeatedly performs processing for measuring the specular light amount and the diffused light amount a predetermined number of times. The CPU 101*a* sets the LED emission intensity to the LED light amounts 2 to 5, and measures the specular light amount and the diffused light amount for each of the LED light amount setting states. The CPU 101*a* stores the average values for the values obtained in the respective measurements as the specular light amount average values P2ave to P5ave and the diffused light amount average values S2ave to S5ave.

In step S203, the CPU 101*a* calculates the light emission amount LP at which the specular light amount is 80% of the maximum received light amount (measurement limit value) based on the relationship between the LED light amounts <1> to <5> and the specular light amount average values P1ave to P5ave.

In step S204, the CPU 101*a* calculates the specular/diffused ratios αbase1 to αbase5 in the base region based on the specular light amount average values P1ave to P5ave and the diffused light amount average values S1ave to S5ave.

In step S205, the CPU 101*a* stores the highest value αbase_max among the specular/diffused ratios αbase1 to αbase5 in the base region.

In step S206, the CPU 101*a* calculates the emission intensity correction coefficient β using the highest value among the specular/diffused ratios in the base region. In the present embodiment, this correction coefficient is calculated using above Expression 2.

In step S207, the CPU 101*a* calculates the LED emission intensity LPlast to be used in control based on the LED emission intensity LP calculated in step S203 and the emission intensity correction coefficient β calculated in step S206.

In step S208, the CPU 101*a* sets the LED emission intensity LPlast calculated in step S207 as the light amount of the density sensor 10 to be used in density detection, and then ends this control. The CPU 101*a* then executes density detection.

According to the above description, the density can be appropriately measured even if, for example, the density sensor 10 has become blotted, or the glossiness of the surface of the intermediate transfer member 27 has decreased due to scratching or blotting caused by wear. As a result, it is possible to minimize downtime, and also eliminate the consumption of toner due to light emission amount adjustment.

Note that although β is obtained using Expression 2 (step S207 in FIG. 7) in the present embodiment, it may be obtained using Expression 4 below.

$$\beta = \alpha base_max + 0.5 \qquad \text{Expression 4}$$

In Expression 4, β is the sum of the highest value among the specular/diffused ratios in the base region and a value obtained by the ratio "100" at which the diffused light amount does not exceed the measurement limit being divided by the target value "200".

Furthermore, the expression for calculating β is not limited to Expressions 2 and 4, and it may be calculated using another linear function or quadratic function employing α. In this way, by obtaining the emission intensity correction coefficient β as a function of a base region specular/diffused ratio α, it is possible to set an LED light amount that enables appropriate density measurement regardless of the state of the surface of the intermediate transfer member 27. Accordingly, it is possible to minimize downtime, and also eliminate the consumption of toner due to light emission amount adjustment.

Also, a configuration is possible in which the emission intensity correction coefficient β is a function of the ratio α of the specular light amount to the diffused light amount in the base region, upper and lower limit values are provided, and a restriction is placed on the calculated LED emission intensity LPlast.

Second Embodiment

Next, a second embodiment of the present invention is directed to an image forming apparatus in which, unlike the first embodiment, the density detection performed by the optical sensor is performed on the photosensitive drums, but the control operation itself is executed in a similar manner. Other aspects of the basic configuration are the same as the first embodiment described above.

Since the photosensitive drums become scratched and blotted more easily than the intermediate transfer member, the effects of the present embodiment are significant, and the present invention can be even more useful in this case. If the amount of control time needed is reduced, the wear of the photosensitive drums can be reduced by a commensurate amount, and therefore this control is advantageous in terms of the photosensitive drum lifetime as well, although in a slight amount.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-035998, filed Feb. 26, 2014, which is hereby incorporated by reference herein in its entirety.

What is claimed is:

1. An image forming apparatus comprising:

an image carrier;

an image forming unit configured to form an image on the image carrier using a developing agent;

a detection unit configured to detect a light amount of reflected light from a measurement image formed on the image carrier by the image forming unit, the detection unit includes an irradiation unit configured to irradiate the measurement image with light, a first light receiving unit configured to receive specular light from the measurement image, and a second light receiving unit configured to receive diffused light from the measurement image;

a controller configured to control an image forming condition based on a detection result by the detection unit; and a determination unit configured to make the irradiation unit irradiate the image carrier using the light, make the first light receiving unit receive specular light from the image carrier, make the second light receiving unit receive diffused light from the image carrier, determine a first emission intensity based on a light amount of the specular light from the image carrier, and determine a second emission intensity based on the determined first emission intensity, the light amount of the specular light from the image carrier, and a light amount of the diffused light from the image carrier, wherein the emission intensity of light with which the irradiation unit irradiates the measurement image is controlled based on the second emission intensity determined by the determination unit.

2. The image forming apparatus according to claim 1, wherein the determination unit determines the second emission intensity based on a ratio of the specular light amount and the diffused light amount, and the first emission intensity.

3. The image forming apparatus according to claim 2, wherein the determination unit makes the irradiation unit irradiate the image carrier using lights with a plurality of emission intensities, makes the first light receiving unit receive specular lights corresponding to each of the plurality of emission intensities, makes the second light receiving unit receive diffused lights corresponding to each of the plurality of emission intensities, and determines the ratio based on the specular light amount and the diffused light amount corresponding to each of the plurality of emission intensities.

4. The image forming apparatus according to claim 3, wherein the specular light amount and the diffused light amount for each of the plurality of emission intensities is an average of measurement values detected at a predetermined interval in the measurement image.

5. The image forming apparatus according to claim 4, wherein the predetermined interval is a time interval or a position interval in the measurement image.

6. The image forming apparatus according to claim 4, wherein the determination unit uses, among ratios of the specular light amount and the diffused light amount detected for each of the plurality of emission intensities, any one of an average value, a lowest value, a highest value, and a median value.

7. The image forming apparatus according to claim 2, wherein the second emission intensity decreases with decrease in a ratio of the specular light amount to the diffused light amount detected in a state in which an image is not formed in a predetermined region by the developing agent, and the second emission intensity increases with increase in the ratio.

8. The image forming apparatus according to claim 2, wherein the determination unit uses a linear function or a quadratic function that is based on the ratio of the specular light amount to the diffused light amount.

9. The image forming apparatus according to claim 1, wherein the specular light amount and the diffused light amount detected when the irradiation unit is emitting light with the second emission intensity are within a range of light amounts that can be detected by the first light receiving unit and the second light receiving unit.

10. An image forming apparatus comprising:

an image forming unit configured to form an image in a predetermined region using a developing agent;

a detection unit configured to detect a density of an image formed by the image forming unit, the detection unit being configured to include an irradiation unit configured to irradiate the predetermined region with light, a first light receiving unit configured to receive specular light from the predetermined region, and a second light receiving unit configured to receive diffused light from the predetermined region; and a control unit configured to control an emission intensity of light with which the detection unit is irradiated by the irradiation unit, wherein the control unit determines an emission intensity for detecting a density of an image formed by the image forming unit such that a specular light amount and a diffused light amount detected by the first light receiving unit and the second light receiving unit are within a detectable range of light amounts, based on a relationship between specular light amounts and diffused light amounts obtained by the first light receiving unit and the second light receiving unit for a plurality of emission intensities set as an emission intensity of the irradiation unit by the control unit in a state in which an image is not formed in the predetermined region by the developing agent.

* * * * *